United States Patent [19]

Satake

[11] Patent Number: 4,940,850

[45] Date of Patent: Jul. 10, 1990

[54] COLOR SORTING APPARATUS

[75] Inventor: Toshihiko Satake, Higashihiroshima, Japan

[73] Assignee: Satake Engineering Co., Ltd., Tokyo, Japan

[21] Appl. No.: 129,712

[22] Filed: Dec. 7, 1987

[30] Foreign Application Priority Data

Feb. 14, 1987 [JP] Japan ..... 62-31858
Feb. 16, 1987 [JP] Japan ..... 62-33929

[51] Int. Cl.[5] ..... B07C 5/342

[52] U.S. Cl. ..... 209/580; 209/582; 209/585; 209/587; 209/639

[58] Field of Search ..... 209/576, 577, 580, 581, 209/582, 585, 587, 588, 639, 644, 920, 908, 910, 911; 250/223 R, 226, 578; 350/438, 439, 482, 483; 356/402, 416, 419, 420; 193/33, 34, 2 B, 2 A, 2 R

[56] References Cited

U.S. PATENT DOCUMENTS

| | | | |
|---|---|---|---|
| 1,538,239 | 5/1925 | Claudepierre | 193/33 |
| 2,678,725 | 5/1954 | Jacobson . | |
| 3,283,896 | 11/1966 | Jirik et al. . | |
| 3,482,686 | 12/1969 | Wood . | |
| 3,782,544 | 1/1974 | Perkins, III | 209/580 X |
| 3,854,586 | 12/1974 | Perkins, III . | |
| 3,993,899 | 11/1976 | Chapman . | |
| 4,088,227 | 5/1978 | Lockett . | |
| 4,134,498 | 1/1979 | Jones et al. | 209/587 X |
| 4,235,342 | 11/1980 | Braham | 209/581 X |
| 4,252,240 | 2/1981 | Satake | 209/580 |
| 4,454,029 | 6/1984 | Codding | 209/581 |
| 4,466,544 | 8/1984 | Satake et al. | 209/580 |
| 4,697,709 | 10/1987 | Codding | 209/581 X |
| 4,699,273 | 10/1987 | Suggi-Liverani et al. | 209/587 X |

*Primary Examiner*—H. Grant Skaggs
*Assistant Examiner*—David H. Bollinger
*Attorney, Agent, or Firm*—Darby & Darby

[57] ABSTRACT

A color sorting apparatus for granular objects comprises a plurality of sorting units arranged in parallel relation to each other. Detecting positions of the respective sorting units are spaced from each other in a horizontal plane. Each sorting unit includes a substantially vertically extending, elongated tubular guide member for guiding the granular objects so as to be moved along a predetermined path passing through the detecting position, three detectors disposed at the detecting position at angular intervals of substantially 120 degrees around the predetermined path, and a deflector operative in response to a signal from at least one of the detectors representative of undesirable granular objects for deflecting the same out of the predetermined path. The arrangement of the three detectors of one of each or a pair of adjacent sorting units is such that the arrangement becomes identical with an arrangement of the three detectors of the other sorting unit, when the three detectors of the one sorting unit is turned substantially 180 degrees around the predetermined path of the one sorting unit.

12 Claims, 8 Drawing Sheets

COLOR SORTING APPARATUS

BACKGROUND OF THE INVENTION

The present invention relates to a color sorting apparatus for granular objects such as agricultural granular material such as cereals, beans or the like and industrial granular material such as pellets, ores or the like.

A Color sorting apparatus of the kind referred to above is disclosed in Japanese patent application 225065/85 which was filed on Oct. 9, 1985 and laid open to the public on Apr. 16, 1987 as the Japanese patent application Laid-Open No. 83078/87 (62-83078A), and comprises a plurality of sorting units arranged in parallel relation to each other. Detecting positions of the respective sorting units are spaced from each other along a horizontal straight line. In each of the sorting units, the granular objects fed by a feeder are guided by a chute so as to be transported along a predetermined path passing through the detecting position of the sorting unit. A light source illuminates the granular objects passing through the detecting position. Three detectors are disposed at the detecting position in angularly spaced relation to each other around the predetermined path.

Each of the three detectors comprises a background-forming means and photodetector elements located on the opposite side of the detecting position from the background-forming means. The photodetector elements receive light reflected from and/or transmitted through the granular objects passing through the detecting position to deliver signals. A control circuit device is responsive to the signals from the photodetector elements representing undesirable granular objects to deliver an actuating signal.

A deflector located below the detecting position is operative in response to the actuating signal from the control circuit device to deflect the undesirable granular objects out of the predetermined path. Thus, desirable granular objects are separated from the undesirable granular objects.

In the color sorting apparatus as described above, the granular objects are directed along the chute by the action of gravity while being in sliding contact with the bottom surface of the chute.

Because the resistances against the motion of the granular objects due to the sliding contact thereof with the bottom surface of the chute change depending on the contact states of the granular particles with the chute, loci of the respective granular objects are changed or disturbed, so that there is fear that the granular objects may not fall along the predetermined path passing through the detecting position. For this reason, it would be difficult for the detectors to accurately detect the undesirable granular objects in some kinds of granular objects.

Further, in the above-described color sorting apparatus, the arrangement of the three detectors in one of a pair of adjacent sorting units is the same as that of the three detectors in the other sorting unit. For this reason, considerable installation area and space are required for the color sorting apparatus, and this results in an increase in total investment in the facilities concerned.

Japanese patent application Laid-Open No. 61-269030 by T. Satake, inventor of the present invention, discloses a color sorting apparatus in which various kinds of granular objects are sorted without changing background means.

U.S. Pat. No. 4,235,342 issued to Braham on Nov. 25, 1980 also discloses a color sorting apparatus in which various kinds of granular objects are sorted without changing background means.

U.S. Pat. No. 3,283,896 issued to Jirik et al on Nov. 8, 1966 discloses a tubular guide member mounted vertically. U.S. Pat. No. 3,482,686 issued to Wood on Dec. 9, 1969 discloses a generally funnel-shaped chute, i.e., tubular guide member.

OBJECT AND SUMMARY OF THE INVENTION

It is an object of the present invention to provide a compact color sorting apparatus which can accurately detect undesirable granular objects or particles.

According to the present invention, there is provided a color sorting apparatus for granular objects, comprising:

a plurality of sorting units arranged in parallel relation to each other, each of the sorting units including:

(i) a detecting position, (ii) feeding means for feeding the granular objects toward the detecting position, (iii) elongated tubular guide means having a longitudinal axis extending substantially vertically, the granular objects fed from the feeding means being moved through and guided by the guide means so as to be moved through or follow a predetermined path passing through the detecting position.

(iv) light source means for illuminating the granular objects passing through the detecting position, (v) three detectors disposed at the detecting position at angular intervals of substantially 120 degrees around the predetermined path, each of the detectors comprising background means and light-receiving means positioned on the opposite side of the detecting position from the background means, for receiving light reflected by and/or transmitted through the granular objects passing through the detecting position to generate a signal, (vi) control circuit means connected to the light-receiving means of the respective detectors and responsive to the signal from at least one of the light-receiving means representing undesirable granular objects, to generate an actuating signal, and (vii) deflecting means located below the detecting position and operative in response to the actuating signal from the control circuit means for deflecting the undesirable granular objects out of the predetermined path, the detecting positions of the respective sorting units being spaced from each other in a horizontal plane; and an arrangement of the three detectors of one of each or a pair of adjacent sorting units being such that the arrangement becomes identical with an arrangement of the three detectors of the other sorting unit, when the arrangement of the three detectors of said one sorting unit is turned substantially 180 degrees around the predetermined path of said one sorting unit.

DETAILED DESCRIPTION

Figure 1:
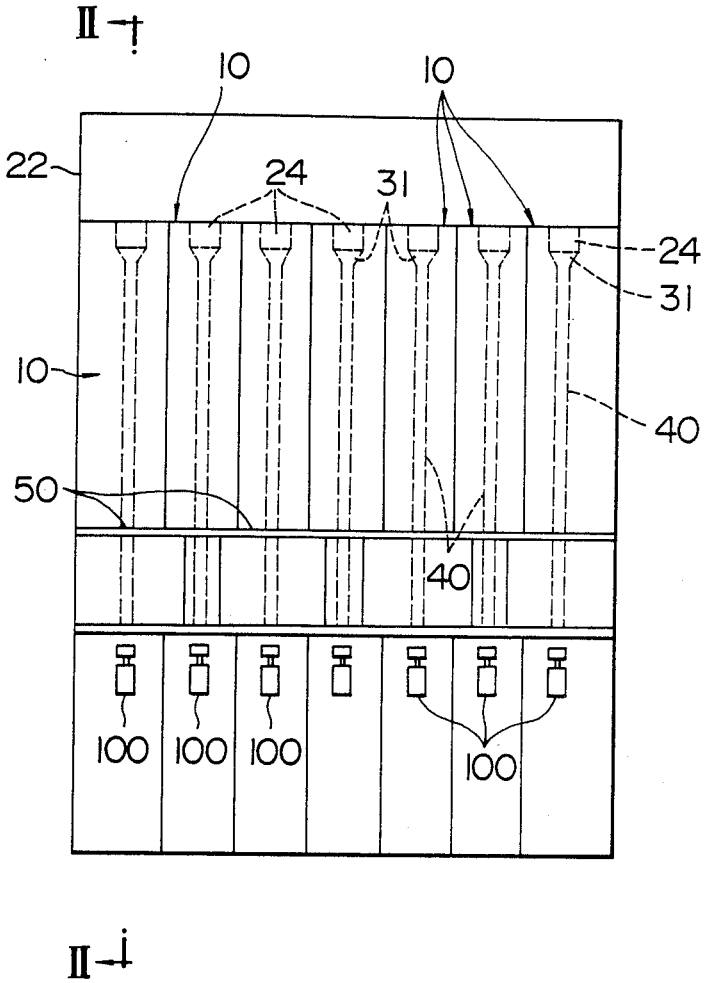
FIG. 1 is a front elevational view showing a color sorting apparatus comprising a plurality of sorting units, in accordance with an embodiment of the invention.
Figure 2:
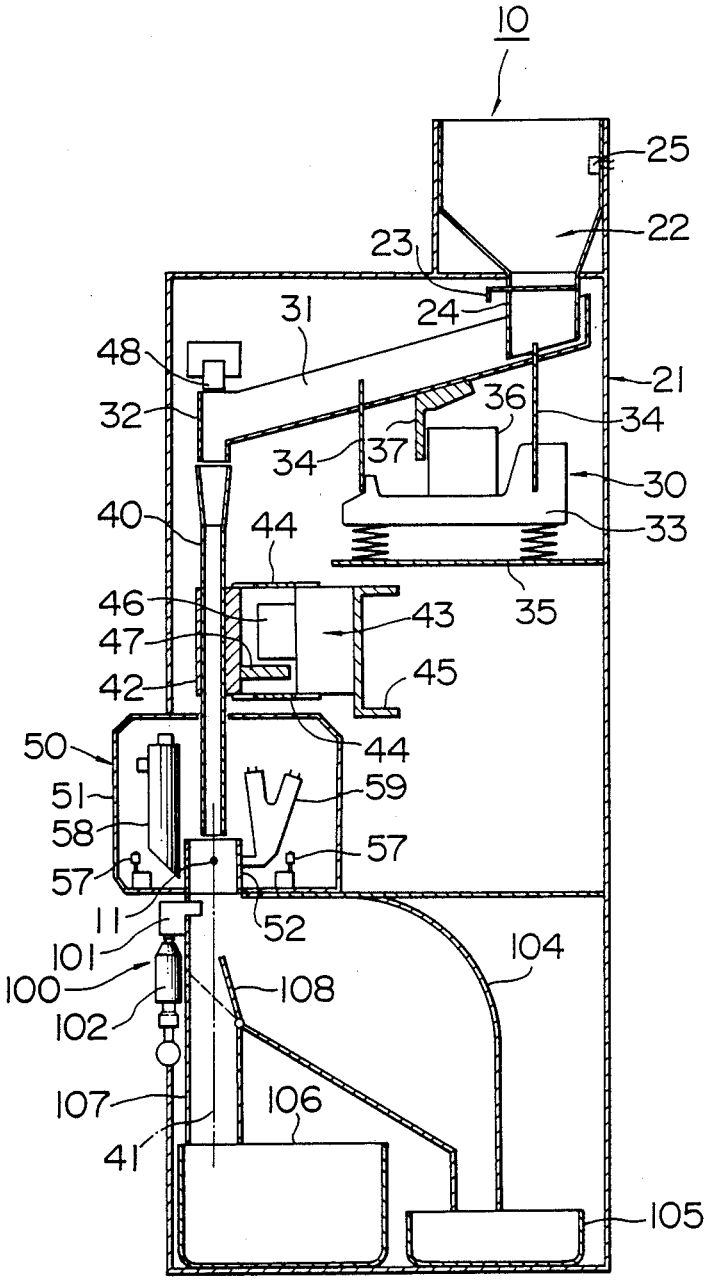
FIG. 2 is a cross-sectional view taken along the line II—II in FIG. 1, showing one of the sorting units.
Figure 9:
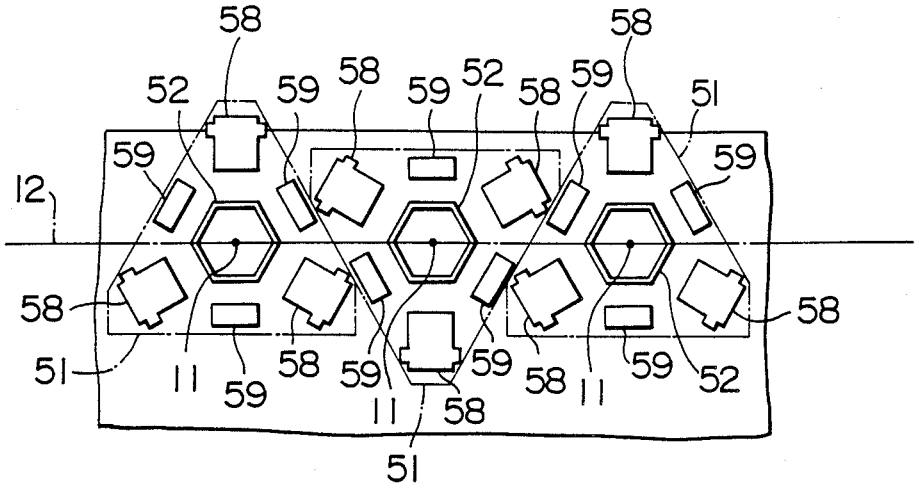
FIG. 9 is a schematic plan view showing the arrangement of the detectors of the respective sorting units.

Referring to FIG. 1, there is shown a color sorting apparatus for granular objects such as agricultural granular material such as cereals, beans or the like and industrial granular material such as pellets, ores or the like. The apparatus comprises a plurality of sorting units 10 arranged in parallel relation to each other. Each of the sorting units 10 includes a detecting position 11, as shown in FIG. 2. The detecting positions 11 of the respective sorting units 10 are spaced from each other in a horizontal plane, as shown in FIG. 9 and, more specifically, are equidistantly spaced from each other along a straight line 12.

As shown in FIG. 2, each sorting unit 10 comprises a frame 21, and a hopper 22 for the granular objects mounted on a top plate of the frame 21. A shutter 23 is slidably mounted to a lower tubular body 24 of the hopper 22 so as to open and close the passage in the tubular body 24. A sensor 25 detects presence and absence of the granular objects within the hopper 22 to issue signals.

A feeder, generally designated by the reference numeral 30, for feeding the granular objects from the hopper 22 toward the detecting position 11 comprises an inclined chute 31 which has an upper end in communication with the hopper 22. A cylindrical portion 32 having a vertical axis is connected to a lower end of the chute 31. The chute 31 is connected to a vibrator 33 through two leaf springs 34, and the vibrator 33 is mounted on a shelf 35. The vibrator 33 has an electromagnetic coil 36 which faces to a magnetic piece 37 fixedly secured to a bottom wall of the chute 31.

An elongated tubular guide member 40 has a longitudinal axis extending substantially vertically. The granular objects from the cylindrical portion 32 of the chute 31 fall through and are guided by the guide member 40 so as to follow a substantially vertically extending, predetermined path 41 passing through the detecting position 11. The guide member 40 has a funnel-shaped upper portion, and an upper end of the funnel-shaped portion is slightly spaced downwardly from a lower end of the cylindrical portion 32 of the chute 31. The guide member 40 is retained by a retainer 42. The retainer 42 is connected to a vibrator 43 through two leaf springs 44, and the vibrator 43 is attached to a beam 45 extending between side walls of the frame 21. The vibrator 43 has an electromagnetic coil 46 which faces to a projection of magnetic material 47 attached to the retainer 42.

A sensor 48 attached to the side wall of the frame 21 adjacent the upper end of the cylindrical portion 32 of the chute 31 detects whether or not the upper funnel-shaped portion of the guide member 40 and/or the cylindrical portion 32 of the chute 31 are/is clogged with the granular objects, to generate a signal when clogged.

Figure 3:
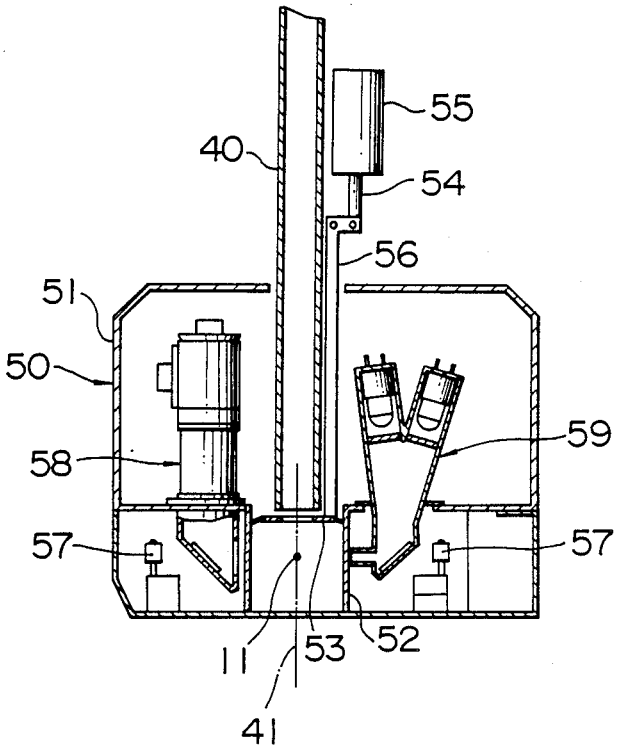
FIG. 3 is an enlarged fragmentary cross-sectional view showing one of three detectors incorporated in the sorting unit illustrated in FIG. 2.

A detecting unit generally designated by the reference numeral 50 comprises an optical case 51 having a triangular cross-section and mounted to the frame 21. The lower end of the guide member 40 extends into the optical case 51 and terminates at a position slightly above the detecting position 11. Located within the optical case 51 are transparent, vertical shield walls 52 made of quartz glass to form, as a whole, a hexagon, surrounding the predetermined path 41, in the horizontal cross-section thereof (refer to FIG. 9). As shown in FIG. 3, a cleaner 53 connected to a piston rod 54 of a pneumatic actuator 55 through a rod 56 has a peripheral edge formed of a resilient material such as rubber and is periodically moved up and down by the actuator 55 to clean the inner peripheral surfaces of the shield walls 52.

At least three halogen lamps 57 are disposed within the optical case 51 the inner surface of which is painted white and is formed for uniform diffuse reflection, in equidistantly spaced relation to each other around the predetermined path 41, to form, as a whole, a light source for illuminating all over the granular objects passing through the detecting position 11.

As clearly shown in FIG. 9, three detectors are disposed within each optical case 51 and at angular intervals of substantially 120 degrees around the detecting position 11. Each of the three detectors comprises a light-receiving assembly 58 and a background assembly 59 positioned on the opposite side of the detecting position 11 from the associated light-receiving assembly 58. The arrangement of the three detectors of one of each pair of adjacent sorting units 10 is such that the arrangement becomes identical with an arrangement of the three detectors of the other sorting unit, when the arrangement of the three detectors of said one sorting unit 10 is turned substantially 180 degrees around the predetermined path 41 passing through the detecting position 11 of said one sorting unit 10.

Figure 4:
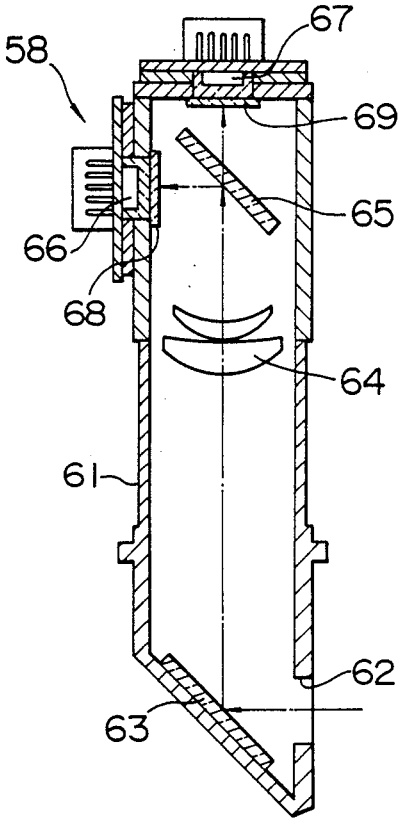
FIG. 4 is a fragmentary cross-sectional view showing a light-receiving assembly of the detector illustrated in FIG. 3.

As shown in FIG. 4, the light-receiving assembly 58 of each detector includes a cylindrical lens barrel 61 having a vertical axis, and the lens barrel 61 is provided in a lower portion thereof with an opening 62 directed toward the detecting position 11. A full-silvered reflecting mirror 63 secured within the lens barrel 61 in a manner of being inclined substantially 45 degrees with respect to a horizontal line passing through the detecting position 11 reflects light horizontally incident upon the mirror 63 through the opening 62 vertically upwardly so that an optical axis of the reflected beam is vertical. The light reflected from the mirror 63 is focused by lenses 64 and directed upon a dichroic mirror 65. The dichroic mirror 65 has, as indicated by the two-dot-and-dash lines a in FIG. 8, such transmission characteristics that, a spectral part of light beam having wavelength longer than a critical value, for example, 590 nm, is substantially reflected from the mirror 65 and a remaining spectral part of the light beam of wavelength shorter than the critical value is substantially transmitted through the mirror 65. A half-silvered reflecting mirror may be used in substitution for the dichroic mirror.

Figure 8:
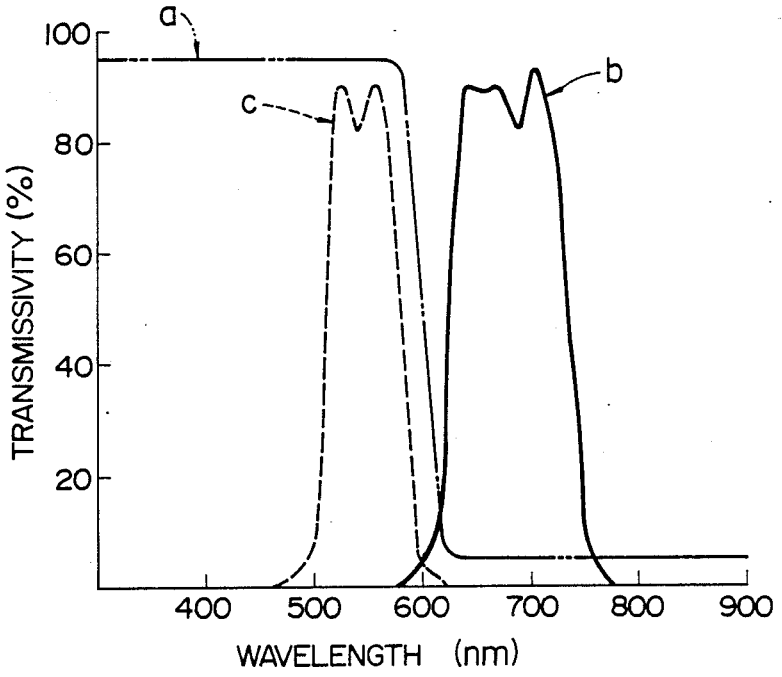
FIG. 8 is a graph showing transmission characteristics of a dichroic mirror and optical filters illustrated in FIG. 4.

Referring back to FIG. 4, a pair of light-receiving elements 66 and 67 are provided, one 66 being attached to the peripheral wall of the lens barrel 61, and the other 67 being attached to the upper end wall of the lens barrel 61. The light-receiving element 66 receives the light reflected by the dichroic mirror 65 and transmitted through a red optical filter 68 to successively generate signals. The light-receiving element 67 receives the light transmitted through the dichroic mirror 65 and transmitted through a green optical filter 69 to successively generate signals. As shown in FIG. 8, the red optical filter 68 allows the light beam of only a wavelength band indicated by the solid line b to be transmitted therethrough, while the green optical filter 69 allows the light beam of only a wavelength band indicated by the broken line c to be transmitted therethrough. The wavelength band indicated by the solid lines b has its main or central wavelength of 670 nm, while the wavelength band indicated by the broken lines c has a main or central wavelength of 550 nm.

Figure 5:
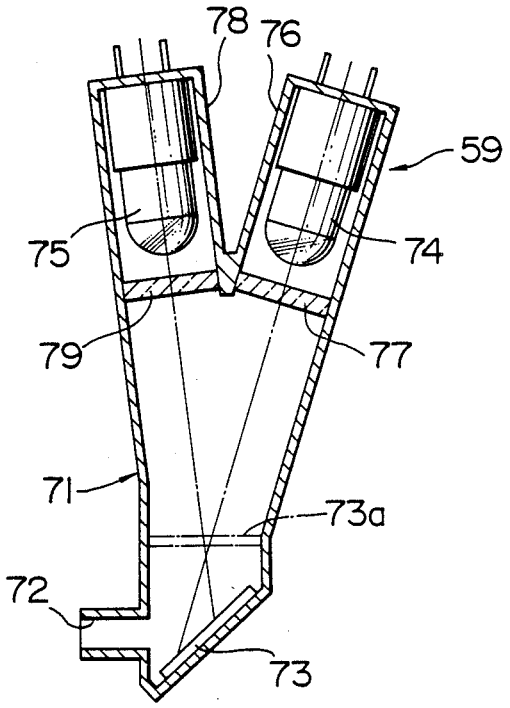
FIG. 5 is an enlarged fragmentary cross-sectional view showing a background assembly of the detector illustrated in FIG. 3.

As shown in FIG. 5, the background assembly 59 comprises a housing 71 having a bifurcated end, and the housing 71 is provided at its lower portion with an opening 72 directed toward the detecting position 11. A background element 73 is formed by an opal glass fixedly secured to the housing 71 in a manner of being inclined substantially 45 degrees with respect to a horizontal line passing through the detecting position 11. A pair of lamps 74 and 75 are provided, one 74 of which is housed within one of legs 76 of the bifurcated end of the housing 71 to illuminate the background element 73 through a red optical filter 77. The other lamp 75 is housed within the other leg 78 of the housing 71 to illuminate the background element 73 through a green optical filter 79. The filters 78 and 79 are substantially identical in the optical characteristic with the filters 68 and 69 of the light-receiving assembly 58, respectively.

The background assembly may include a semi-transparent glass **73*a* indicated by the dot-and-dash lines in FIG. 5, where the component designated by 73 is a full-silvered reflecting mirror. The semi-transparent glass 73*a* is positioned between the filters 77, 79 and the full-silvered reflecting mirror 73**.

The light-receiving elements 66, 67 are arranged such that the elements 66, 67 receive light only from the background assembly 59 when the granular object is absent at the detecting position 11, and such that the elements 66, 67 receive light from the background assembly 59 and light from the lamp 57 which are reflected by and/or transmitted through the granular object when the object passes through the detecting position 11.

Figure 6:
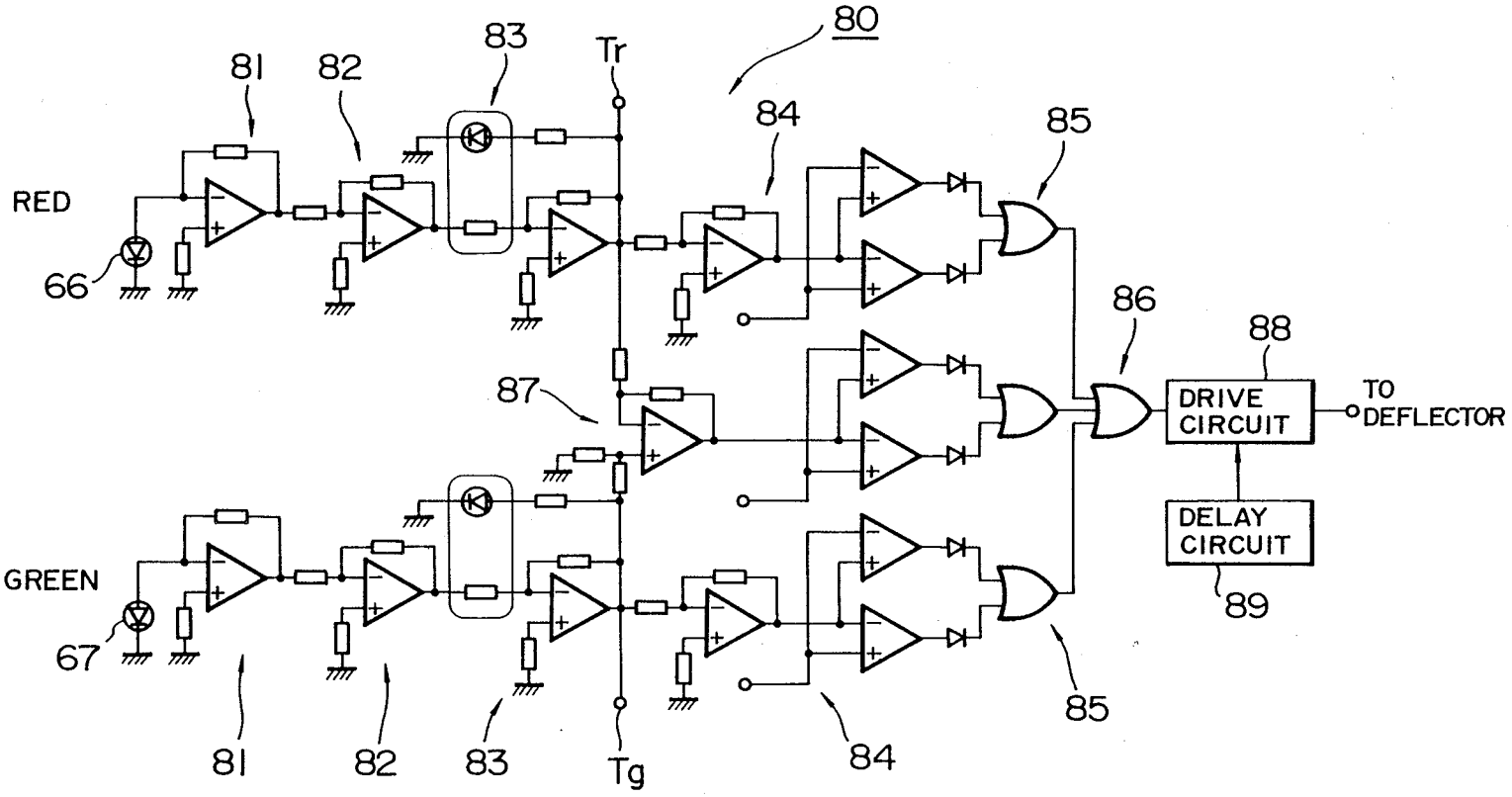
FIG. 6 is a block diagram showing a control circuit device associated with the detector illustrated in FIG. 3.

The pair of light-receiving elements 66 and 67 of each detector are connected to a control circuit device generally designated by the reference numeral 80 in FIG. 6. The control circuit device 80 may be one as disclosed in U.S. Pat. No. 3,782,544 issued to Perkins, III on Jan. 1, 1974 or U.S. Pat. No. 3,854,586 issued to Perkins, III on Dec. 17, 1974. The control circuit device 80 will, therefore, be described briefly. The control circuit device 80 comprises two amplification circuits 81 and 82 connected in series to the light-receiving element or photocell 66 associated with the red optical filter 68, for amplifying the output signal from the light-receiving element 66. The amplification circuit 82 is connected to an AGC automatic gain control circuit 83 for automatically controlling the gain of the amplified signal from the amplification circuit 82. The AGC circuits 83, 83 serve for adjusting the output levels concerning the red and green, and for correcting the variation in the intensities of light source. The AGC circuit 83 is connected to a comparator circuit 84 where the gain-controlled output signal from the light-receiving element 66 is compared with a reference level. The comparator circuit 84 is connected to an OR CIRCUIT 85.

Similarly to the light-receiving element 66, the light-receiving element 67 associated with the green optical filter 69 is connected to the amplification circuits 81 and 82, AGC circuit 83, comparator circuit 84 and OR circuit 85. The OR circuits 85 and 85 associated respectively with the light-receiving elements 66 and 67 are connected to a common OR circuit 86.

The AGC circuits 83 and 83 associated respectively with the light-receiving elements 66 and 67 are connected to a calculation circuit 87 for obtaining a difference between the output signals from the respective light-receiving elements 66 and 67. The calculation circuit 87 is connected to the OR circuit 86 through a comparator circuit 84 and an OR circuit 85.

The OR circuit 86 is connected to a drive circuit 88 which is responsive to the signal from the OR circuit 86 representing detection of undesirable granular objects by at least one of the pair of light-receiving elements 66, 67 to generate an actuating signal. Connected to the drive circuit 88 is a delay circuit 89 which acts to delay, by a predetermined time duration, the time when the drive circuit 88 generates the actuating signal on the basis of the signal from the OR circuit 86.

Figure 7:
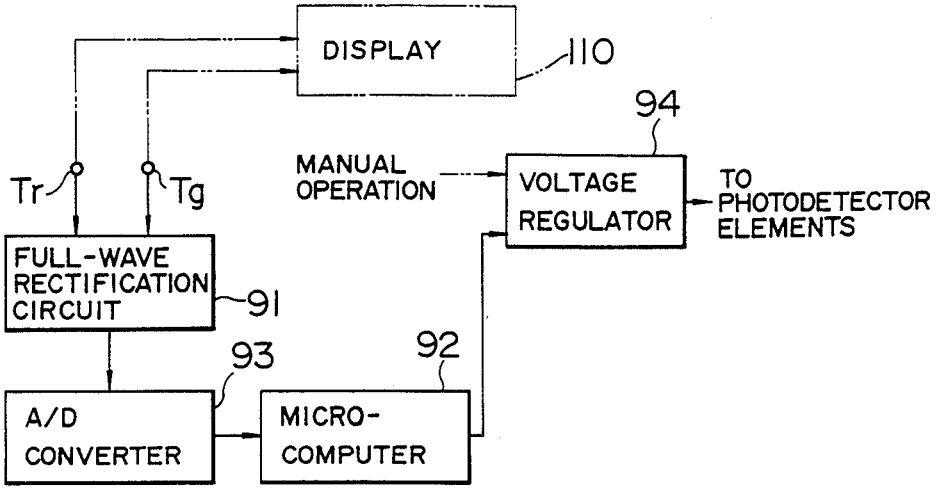
FIG. 7 is a block diagram showing an adjusting circuit connected to the control circuit device illustrated in FIG. 6.

The AGC circuits 83 and 83 associated respectively with the light-receiving elements 66 and 67 are connected to a full-wave rectification circuit 91 shown in FIG. 7, through terminals Tr and Tg. The full-wave rectification circuit 91 is connected to a microcomputer 92 through an A/D (analog-to-digital) converter 93. A voltage regulator 94 for regulating the voltages applied to the lamps 74 and 75 of the background assembly 59 independently of each other is operated in response to a signal from the microcomputer 92.

Referring back to FIG. 2, a deflector generally designated by the reference numeral 100 is located below or downstream of the detecting position 11. The deflector 100 comprises an injection nozzle 101 connected to a source of compressed air (not shown) and directed toward the predetermined path 41, and a valve 102 provided in a pipe between the source of compressed air and the injection nozzle 101. The valve 102 is connected to the drive circuit 88 described previously with reference to FIG. 6 and is responsive to the actuating signal from the drive circuit 88 to open the pipe to permit the compressed air to be injected from the injection nozzle 101, to thereby deflect the undesirable granular objects out of the predetermined path 41. The deflected undesirable granular objects pass through a duct 104 and are collected by a container 105. Desirable granular objects which are not deflected by the deflector 100 continue to fall along the predetermined path 41 and through a duct 107 and are collected by a container 106. A valve 108 is provided which is movable between an open position indicated by the solid lines in FIG. 2 where the duct 107 is opened and a closed position indicated by the broken lines in FIG. 2 where the duct 107 is closed.

The operation of the color sorting apparatus described above with reference to FIGS. 1 through 9 will be described. In FIG. 2, as it is detected and indicated by the sensor 25 that the hopper 22 is filled with the granular objects, an operator operates a switch on a control panel (not shown) to permit half-wave-rectified electric current controllable in amplitude to be supplied from the power source to the electromagnetic coil 36 of the vibrator 33. The chute 31 is vibrated at an oscillation frequency identical with that of the current from the power source and in synchronism therewith. If necessary, the vibrator 43 associated with the tubular guide member 40 may be operated to vibrate the tubular guide member 40 along its longitudinal axis at a small vibration amplitude. The operator moves the shutter 23 to open the passage in the tubular body 24, thereby permitting the granular objects to be fed from the hopper 22 to the chute 31 which is being vibrated. The granular objects are delivered from the cylindrical portion 32 to the upper funnel-shaped portion of the tubular guide member 40. The granular objects fall under the action of the gravity, while being accelerated, through the vertically extending, tubular guide member 40 without being substantially contacted with the inner peripheral wall surface of the guide member 40. The granular objects fall along the predetermined path 41 and pass through the detecting position 11.

As the sensor 48 detects that the cylindrical portion 32 of the chute 31 and/or the upper funnel-shaped portion of the guide member 40 are/is clogged with the granular objects, the vibration of the chute 31 is weakened or stopped. As the sensor 48 detects that the clogging is released or all the passages in the cylindrical portion 32 of the chute 31 and the upper funnel shaped portion of the guide member 40 are reopened by the vibration of the guide member 40, the vibration of the chute 31 is strengthened or restarted. The guide member 40 may be always vibrated, or may be vibrated only when the clogging of the granular objects is detected by the sensor 48. In the case where the guide member 40 is always vibrated the vibration is made stronger or heavier when the clogging is detected by the sensor 48. An alarm device operated in response to the signal from the sensor 48 representative of the clogging may be attached to the control panel.

As shown in FIG. 3, the granular objects passing through the detecting position 11 are illuminated indirectly by way of the white inner wall of the case 51 and/or directly by the halogen lamps 57. Light reflected from and/or transmitted through the granular objects is reflected by the mirror 63 of the light-receiving assembly 58, as shown in FIG. 4. The light from the mirror 63 is focused or condensed by the lenses 64 and is directed to the dichroic mirror 65. A part of the light incident upon the dichroic mirror 65 is reflected thereby and is received by the light-receiving element 66 through the red optical filter 61. The remaining part of light incident upon the dichroic mirror 65 is transmitted therethrough and is received by the light-receiving element 67 through the green optical filter 69.

As shown in FIG. 6, the output signal from the light-receiving element 66 associated with the red optical filter 68 is appropriately amplified by the amplification circuits 81 and 82, and the gain or amplification rate of the amplified signal is automatically adjusted by the circuit 83. The adjusted signal is compared with the reference level in the comparator circuit 84, and the output signal from the comparator 84 is delivered into the OR circuits 85 and 86. The output signal from the light-receiving element 67 associated with the green optical filter 69 is processed similarly with the output signal from the light-receiving element 66, and is transferred into the OR circuits 85 and 86. The output signals from the respective AGC circuits 83 and 83 are given to the calculation circuit 87 where subtraction is effected between the output signals. The output signal from the calculation circuit 87 is delivered into the comparator circuit 84 where the output signal is compared with the present reference level, and the output signal from the comparator circuit 84 is given to the OR circuits 85 and 86. The signal delivered from the OR circuit 86 representing undesirable granular objects is sent to the drive circuit 88. After delay of the predetermined period of time by the signal from the delay circuit 89, the drive circuit 88 generates the actuating signal.

Referring back to FIG. 2, the valve 102 of the deflector 100 is moved to the open position in response to the actuating signal from the drive circuit 88 to permit the compressed air to be injected from the injection nozzle 101. The injection of the compressed air causes the undesirable granular objects to be deflected out of the predetermined path 41, and the deflected objects pass through the duct 104 and are received in the container 105. Desirable granular objects are not subjected to the compressed air from the nozzle 101 and fall along the predetermined path 41. The desirable objects pass through the duct 107 and are received in the container 106.

At the beginning of the operation of the apparatus, the hue of the light from the background element 73 is not necessarily adjusted to conform with the hue of the desirable granular objects. For this reason, the valve 108 is moved to the closed position indicated by the broken lines in FIG. 2 at the beginning of the operation of the apparatus, so that the desirable granular objects which are not deflected by the deflector 100 pass also through the duct 104 and are received in the container 105. After the hue of the light from the background element 73 is adjusted, as explained hereinafter, to conform with that of the desirable granular objects, the valve 108 is moved to the open position indicated by the solid lines in FIG. 2 to enable the desirable granular objects to be received in the container 106.

The adjustment of the hue of the light from the background element 73 or from the background assembly 59 will be described with reference to FIGS. 6 and 7. At first, the intensities of the lamps 74, 75 of the background assembly 59 are preset so that the amount on spectral intensities of the light from the background element 73 to be detected by the light-receiving elements 66, 67 become approximately the same as those reflected from and/or transmitted through the desirable granular object(s) to be detected by the light-receiving elements 66, 67 when the desirable granular object(s) passes through the detecting point 11. At the beginning of the operation of the apparatus a first adjusting signal from the light-receiving element 66 corresponding to the amount of light from the background assembly 59, preset as explained above, at a time when the granular objects do not pass through the detecting position 11 is delivered from the terminal Tr of the control circuit device 80 shown in FIG. 6. The first adjusting signal from the terminal Tr is, as shown in FIG. 7, given to the microcomputer 92 through the full-wave rectification circuit 91 and the A/D converter 93, and is stored in the microcomputer 92. Then, a second adjusting signal delivered from the light-receiving element 66 at a time when the desirable granular object passes through the detecting position 11 is given to the microcomputer 92 and is stored therein, in a similar manner as the first adjusting signal. The microcomputer 92 compares the first and second adjusting signals with each other and sends a control signal based on the comparison, to the voltage regulator 94. Based on the control signal from the microcomputer 92, the voltage regulator 94 regulates the voltage applied to the lamp 74 associated with the red optical filter 77 so that the voltage is gradually either lowered or enhanced. The microcomputer 92 continues to send the control signal to the voltage regulator 94 until the difference between the first and second adjusting signals becomes smaller than a predetermined magnitude. Once the difference between the first and second adjusting signals is made smaller than the predetermined magnitude, the voltage adjustment of the lamp 74, i.e., the hue adjustment of the background element 73 or background assembly 59 in terms of "red" is completed.

Similarly, based on first and second adjusting signals from the light-receiving element 67 associated with the green optical filter 69, the voltage applied to the lamp 75 associated with the green optical filter 79 is adjusted independently of the lamp 74.

The above-described hue adjustment of the background element 73 or the background assembly 59 is effected in each of the three detectors of each of the sorting units 10.

The above-described hue adjustment of the background assembly 59 or background element 73 is effected automatically in accordance with the program incorporated into the microcomputer 92. However, the adjustment can be effected manually, as indicated by the two-dot-and-dash lines in FIG. 7. Specifically, the first and second adjusting signals from each of the terminals Tr and Tg are sent to a display device 110 such as synchroscope, and are displayed on a screen thereof. The operator operates the voltage regulator 94 while watching the screen of the display device 110, to reduce the difference between the first and second adjusting signals.

Figure 10:
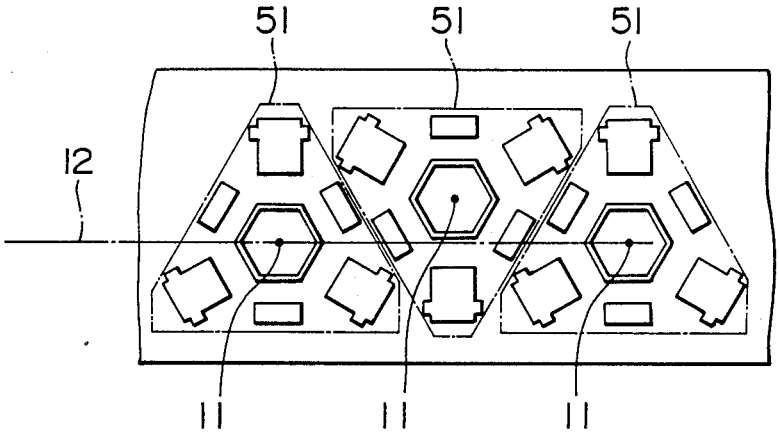
FIG. 10 is a view similar to FIG. 9, but showing another arrangement of the detectors.

FIG. 10 is a view similar to FIG. 9, but showing another embodiment of the invention. In FIG. 10, like or same reference numerals are used to designate components like or similar to those shown in FIG. 9, and the description of such similar components will therefore be omitted. In the embodiment shown in FIG. 10, the detecting positions 11 of the respective sorting units are located in a horizontal plane. The straight line 12 passing through the respective detecting positions 11 of alternate sorting units is spaced from the detecting position 11 of the intermediate sorting unit. It is possible for the embodiment of FIG. 10 to reduce the dimension or size of the apparatus in a horizontal direction perpendicular to the straight line 12, to be less than that of the apparatus shown in FIG. 9.

As described above, the color sorting apparatus according to the invention comprises a plurality of sorting units arranged in parallel relation to each other, and each of the sorting units includes an elongated tubular guide member 40 having a longitudinal axis extending substantially vertically. Granular objects are not substantially influenced from the inner peripheral wall surface of the guide member 40 so that it is ensured that the objects fall along the predetermined path 41. This makes it possible for the detectors to accurately detect undesirable granular objects.

Moreover, the arrangement of the three detectors of one of each or a pair of sorting units 10 and 10 is such that the arrangement becomes identical with an arrangement of the three detectors of the other sorting unit when the arrangement of the three detectors of said one sorting unit 10 is turned substantially 180 degrees. This makes it possible to reduce the size of the sorting apparatus in a horizontal direction perpendicular to the direction in which the sorting units are arranged, to thereby reduce the total cost of equipment.

What is claimed is:

1. A color sorting apparatus for granular objects, comprising:

a plurality of sorting units arranged in parallel relation to each other, each of said sorting units including:

(i) a detecting position, (ii) a hopper and feeding means for feeding the granular objects from the hopper toward said detecting position, the feeding means including an inclined chute having an upper end in communication with the hopper, a vertical cylindrical portion connected to and communicating with a lower end of the chute at a side wall of an upper part thereof and extending vertically downwardly below the lower end of the chute and downwardly terminating in a lower end, and a vibrator means for vibrating the chute and the cylindrical portion, (iii) elongated tubular guide means arranged for receiving the granular objects from said lower end of the cylindrical portion of said feeding means and for guiding the granular objects therethrough, said guide means having an upper end of a diameter substantially the same as that of said lower end of the cylindrical portion and being in alignment therewith, and a longitudinal axis extending substantially vertically, the granular objects from the cylindrical portion being moved through and guided by said guide means so as to follow a predetermined path passing through said detecting position, (iv) light source means for illuminating the granular objects passing through said detecting position, (v) three detectors disposed at said detecting position at angular intervals of substantially 120 degrees around said predetermined path, each of said detectors comprising background means for providing a background and light-receiving means, positioned on the opposite side of said detecting position from said background means, for receiving light reflected by and/or transmitted through the granular objects passing through said detecting position to generate a signal, (vi) control circuit means, connected to said light-receiving means of the respective detectors, for generating an actuating signal responsive to the signal from at least one of said light-receiving means representing undesirable granular objects, and (vii) deflecting means located below said detecting position and operative in response to the actuating signal from said control circuit means for deflecting the undesirable granular objects out of said predetermined path, the detecting positions of the respective sorting units being spaced from each other in a horizontal plane.

2. A color sorting apparatus as defined in claim 1, including:

at least three sorting units; and the respective detecting positions of said at least three sorting units being spaced from each other along a straight line.

3. A color sorting apparatus as defined in claim 1, including:

at least three sorting units; and a straight line passing through the respective detecting positions of alternate sorting units of said at least three sorting units being spaced from the detecting position of an intermediate one of said at least three sorting units.

4. A color sorting apparatus as defined in claim 1, wherein each of said sorting units comprises means for vibrating a corresponding one of the guide means along its longitudinal axis.

5. A color sorting apparatus as defined in claim 1, wherein each of the three detectors of each of said sorting units comprises a mirror positioned between the detecting position of the sorting unit and the light-receiving means of the detector, for reflecting light from the detecting position to direct such light substantially an parallel to the longitudinal axis of said tubular guide means to said light-receiving means.

6. A color sorting apparatus as defined in claim 1, wherein each of said sorting units includes:

each of the three detectors including;

(i) the light-receiving means of the detector having first and second light-receiving elements, (ii) a first optical filter positioned between the detecting position of the sorting unit and the first light-receiving element and a second optical filter positioned between the detecting position and the second light-receiving element, the first optical filter allowing a first wavelength band of the light incident upon the first optical filter to be transmitted therethrough, and the second optical filter allowing a second wavelength band of the light incident upon the second optical filter to be transmitted therethrough, the first wavelength band being different from the second wavelength band, (iii) first and second lamps illuminating the background means of the detector, and (vi) a third optical filter positioned between the background means and the first lamp and a fourth optical filter positioned between the background means and the second lamp, the third optical filter allowing a wavelength band of the light irradiated from the first lamp to the background means substantially identical with the first wavelength band, to be transmitted through the third optical filter, and the fourth optical filter allowing a wavelength band of the light irradiated from the second lamp to the background means substantially identical with the second wavelength band, to be transmitted through the fourth optical filter, the first and second light-receiving elements of each of the three detectors being connected to the control circuit means of the sorting unit, the control circuit means being responsive to the signals from the respective first and second light-receiving elements corresponding to intensities of the light from the background means of the detector at a time when the granular objects do not pass through the detecting position of the sorting unit, to respectively issue first adjusting signals, and responsive to the signals from the respective first and second light-receiving elements at a time when desirable granular objects pass through the detecting position to respectively issue second adjusting signals; and adjusting means connected to the control circuit means for adjusting light intensities of the corresponding lights irradiated from the respective first and second lamps so as to reduce each of differences between the first and second adjusting signals from each of the first and second light-receiving elements to be less than a predetermined magnitude.

7. A color sorting apparatus as defined in claim 6, wherein each of the three detectors of each of said sorting units has a dichroic mirror positioned between the detecting position of the sorting unit and the first and second optical filters of the detector.

8. A color sorting apparatus as defined in claim 6, wherein, in each of the three detectors of each of the sorting units, the first optical filter of the detector is a red optical filter, and the second optical filter of the detector is a green optical filter.

9. A color sorting apparatus as defined in claim 6, wherein the background means of each of the detectors comprises an opal glass common to the first and second light-receiving elements of the detector.

10. A color sorting apparatus as defined in claim 6, wherein the background means of each of said detectors comprises a semi-transparent glass common to the first and second light-receiving elements of the detector.

11. A color sorting apparatus as defined in claim 6, wherein the adjusting means of each of the sorting units comprises a microcomputer generating a control signal in response to the first and second adjusting signals from the control circuit means of the sorting unit based on the signals from the first and second light-receiving elements of each detector of the sorting unit, and a voltage regulator for adjusting voltages applied respectively to the first and second lamps of the detector independently of each other, the voltage regulator being automatically controlled by the control signal from the microcomputer.

12. A color sorting apparatus for granular objects, comprising:

a plurality of sorting units arranged in parallel relation to each other, each of said sorting units including:

(i) a detecting position, (ii) feeding means for feeding the granular objects toward said detecting position, (iii) elongated tubular guide means arranged for receiving the granular objects from said feeding means and for guiding the granular objects therethrough, said guide means having a longitudinal axis extending substantially vertically, the granular objects fed from said feeding means being moved through and guided by said guide means so as to follow a predetermined path passing through said detecting position, (iv) light source means for illuminating the granular objects passing through said detecting position, (v) three detectors disposed at said detecting position at angular intervals of substantially 120 degrees around said predetermined path, each of said detectors comprising background means for providing a background and light-receiving means, positioned on the opposite side of said detecting position from said background means, for receiving light reflected by and/or transmitted through the granular objects passing through said detecting position to generate a signal, (vi) control circuit means, connected to said light-receiving means of the respective detectors, for generating an actuating signal responsive to the signal from at least one of said light-receiving means representing undesirable granular objects, and (vii) deflecting means located below said detecting position and operative in response to the actuating signal from said control circuit means for deflecting the undesirable granular objects out of said predetermined path, the detecting positions of the respective sorting units being spaced from each other in a horizontal plane, and an arrangement of the three detectors of one of a pair of adjacent sorting units being such that the arrangement becomes identical with an arrangement of the three sorting detectors of the other sorting unit of said pair, when the arrangement of the three detectors of said one sorting unit of said pair is turned substantially 180 degrees around the predetermined path of said one sorting unit; and wherein with respect to each of said sorting units, each the three detectors thereof includes (viii) the light-receiving means of the detector having first and second light-receiving elements, (ix) a first optical filter positioned between the detecting position of the sorting unit and the first light-receiving element and a second optical filter positioned between the detecting position and the second light-receiving element, the first optical filter allowing a first wavelength band of the light incident upon the first optical filter to be transmitted therethrough, and the second optical filter allowing a second wavelength band of the light incident upon the second optical filter to be transmitted therethrough, the first wavelength band being different from the second wavelength band, (x) first and second lamps illuminating the background means of the detector, and (xi) a third optical filter positioned between the background means and the first lamp and a fourth optical filter positioned between the background means and the second lamp, the third optical filter allowing a wavelength band of the light irradiated from the first lamp to the background means substantially identical with the first wavelength band, to be transmitted through the third optical filter, and the fourth optical filter allowing a wavelength band of the light irradiated from the second lamp to the background means substantially identical with the second wavelength band, to be transmitted through the fourth optical filter, the first and second light-receiving elements of each of the three detectors being connected to the control circuit means of the sorting unit, the control circuit means being responsive to the signals from the respective first and second light-receiving elements corresponding to intensities of the light from the background means of the detector at a time when the granular objects do not pass through the detecting position of the sorting unit, to respectively issue first adjusting signals, and responsive to the signals from the respective first and second light-receiving elements at a time when desirable granular objects pass through the detecting position to respectively issue second adjusting signals, and adjusting means connected to the control circuit means for adjusting light intensities of the corresponding lights irradiated from the respective first and second lamps so as to reduce each of differences between the first and second adjusting signals from each of the first and second light-receiving elements to be less than a predetermined magnitude; and furthermore wherein the adjusting means of each of the sorting units comprises a display device displaying, on a screen thereof, the first and second adjusting signals from the control circuit means of the sorting unit based on the signals from the first and second light-receiving elements of each detector of the sorting unit, and a voltage regulator for adjusting voltages applied respectively to the first and second lamps of the detector independently of each other, the voltage regulator being operated manually by an operator based on the display on the screen of the display device.

* * * * *